United States Patent [19]

Cerniway et al.

[11] 4,000,534

[45] Jan. 4, 1977

[54] BUOYANCY COMPENSATOR

[75] Inventors: Leon A. Cerniway, Mission Viejo; Donald W. Entrikin, Newport Beach, both of Calif.

[73] Assignee: U. S. Divers Company, Santa Ana, Calif.

[22] Filed: June 13, 1975

[21] Appl. No.: 586,616

Related U.S. Application Data

[63] Continuation of Ser. No. 427,545, Dec. 26, 1973, abandoned.

[52] U.S. Cl. ..... 9/342; 9/314; 9/318; 9/338

[51] Int. Cl.[2] ..... B63C 9/18

[58] Field of Search ..... 9/311, 313, 314, 315, 9/316, 318, 319, 321–324, 340–342; 128/142.5, 140 R; 61/70, 69 R; 222/3, 5; 251/294

[56] References Cited

UNITED STATES PATENTS

| | | | |
|---|---|---|---|
| 2,842,785 | 7/1958 | Sieverts | 9/342 |
| 3,436,777 | 4/1969 | Greenwood | 9/342 |
| 3,747,139 | 10/1971 | Braly | 9/313 |
| 3,866,253 | 2/1975 | Sinks et al. | 9/313 |
| 3,877,098 | 4/1975 | Braly | 9/313 |

*Primary Examiner*—Trygve M. Blix
*Assistant Examiner*—Sherman D. Basinger

[57] ABSTRACT

A buoyancy compensator having a combined capability. The combination is in part provided by a pressure relief valve having a spring loaded valve plate for closing off the interior of the buoyancy compensator. The buoyancy compensator has a hand actuated inflation apparatus which receives a tube connected at its other end to a source of gas under pressure such as a first stage regulator. The tube or hose is inserted in the apparatus and is partially valved by a Shrader type valve configuration in an end fitting thereof. The vest is provided with a plug and fitting wherein the inflation apparatus can be utilized optionally by subsequent implacement or retrofitting the vest with the inflation apparatus. The buoyancy compensator vest also incorporates an oral inflator which utilizes a plunger operated valve for filling the vest. In cases of emergency, a charged bottle of gas can be punctured to fill the vest to allow a diver to rise rapidly to the surface. The entire vest is made of an outer textile material which serves to prevent the expansion of a non-adhered free bladder beyond a fixed point therein. The vest and combination are attached to the body by straps around the waist, over the back, or through the legs.

10 Claims, 12 Drawing Figures

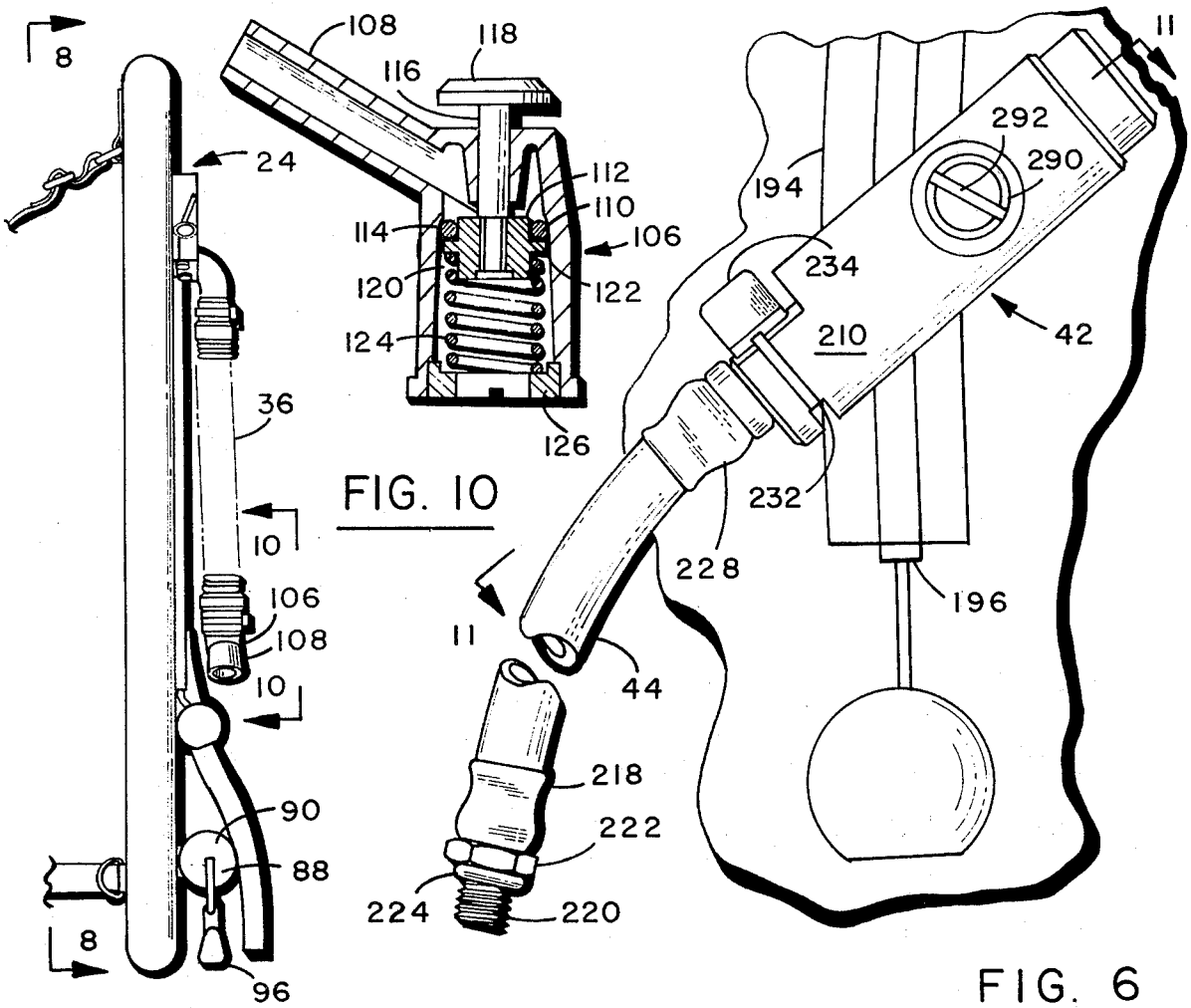
FIG. 10
FIG. 6
FIG. 7
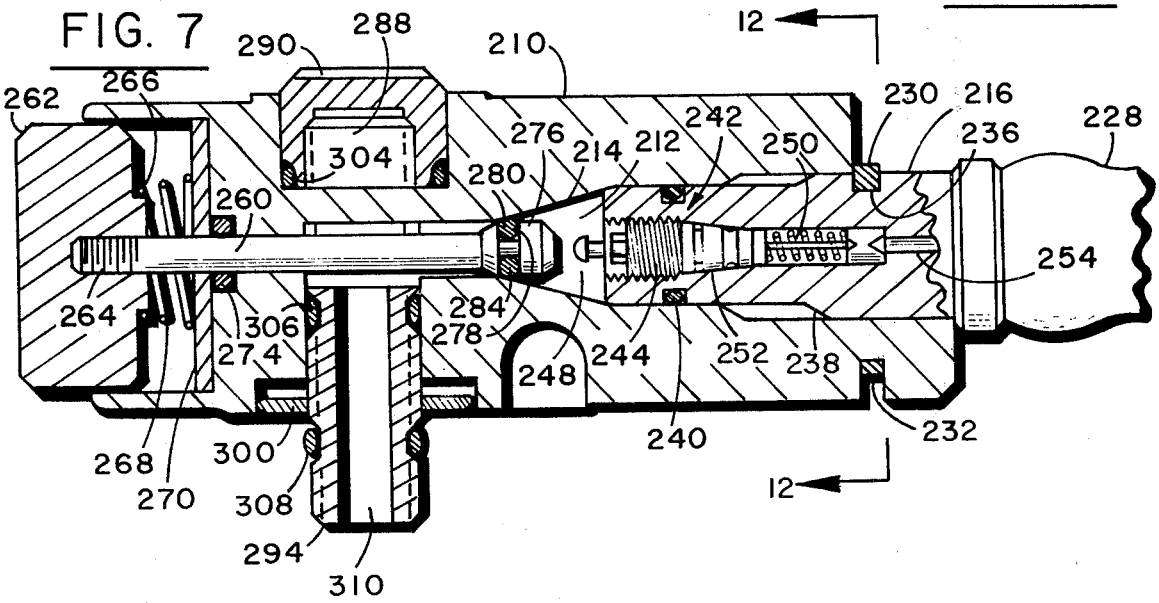
FIG. 11

BUOYANCY COMPENSATOR

This is a continuation of application Ser. No. 427,545, filed Dec. 26, 1973, and now abandoned.

BACKGROUND OF THE INVENTION

The field of this invention lies within the buoyancy compensator art. Specifically, it relates to the art of buoyancy compensators which provide a specific buoyancy to a diver when he is immersed. In addition thereto, the vest can be utilized for life saving purposes when a diver is incapacitated or immobilized.

THE PRIOR ART

The prior art related to buoyancy compensators and certain devices associated therewith, has generally dealt with life vests, buoyancy compensators and certain floatation and filling devices.

Some vests and life preservers have been made of an inflatable fabric, as well as static floatation material. Inflatable vests and life jackets incorporate such features as inflatable bladders, collars, and generally oriented tubular members connected to either oral inflation means or pressurized gaseous inflation means. When oral inflation means are utilized, a hand actuated valve at or near the end of the oral inflation tube is used. When pressurized gaseous inflation is utilized, it is oftentimes common to puncture a CO2 cartridge or other gaseous container for purposes of inflating the vest. In addition thereto, some refillable gas bottles are utilized which can be monitored or controlled, so that the amount of gas that goes into the vest can be throttled.

Departing from the foregoing basic life vests and buoyancy compensators, the prior art shows variations, including dual gas inflation means, various bladder orientations, and numerable gas filling means in the form of oral inflation devices.

Aside from the foregoing, the prior art also includes a specific means for releasing the gas in the vest. However, release of the gas in the vest is oftentimes done on a substantially slow basis so that the amount of gas does not become released in sufficient quantities to prevent the vest from expanding beyond its limits. If a diver using such a vest moves rapidly to a less pressurized area, such as toward the surface of a body of water, the vest might explode. This problem is eliminated by this invention, wherein the diver can now rely upon his vest to "dump" the gas in a safe and effective manner. Thus, the diver will not be placed in a precarious position wherein the vest will not support the diver's body adequately, or tend to overexpand at reduced ambient pressures.

The relief valving means of this invention is a substantial step over the art by reason of the fact that it allows a "dumping" or release of the gas in the vest with a superior release function. The relief valve functions in a positive manner wherein it is seated so that it can virtually never become stuck. The inability to stick the valve in a closed position is quite important to prevent the vest from overexpanding or overinflating at a given depth. The prior art also shows means for filling the vest from a source of breathing gas. Specifically, filling can take place by means of a tubular connection between one's breathing tank and the vest. However, in such showings of the prior art, the filling of the vest does not take place except through certain catches, latches, and filling means which are cumbersome. The coupling means are such that they require snaps, or spring loaded clips. Furthermore, the check valve which is utilized with the device does not enable a rapid and easy connection for inflation purposes.

As can be understood, when a diver is in a precarious location, or requires gas for purposes of acquiring positive buoyancy, the connection and inflation must be quickly effectuated. The prior art devices do not enable this in a rapid and facile manner. Furthermore, the prior art utilizes connections which are cumbersome and are in effect a large valve head and fitting which swings at the end of a tube between the first stage regulator of the breathing gas tanks, and the end thereof. As can be appreciated, this is a pendulous device which oftentimes can foul or get in the way of a diver. To the contrary, the invention utilizes a single tube with a valve in cooperation with filling apparatus connected to the vest for easy and positive inflation at will.

Many of the foregoing advances as recited, as well as other features of this invention, taken singularly and in combination, will become more readily apparent by reading the following specification.

SUMMARY OF THE INVENTION

In summation, this invention comprises a new and novel floatation vest or buoyancy compensator which can be inflated by numerous means, singularly or in combination with each other. Also, certain optional appurtenant valving means enhance the flexibility and use of the invention. More specifically, the invention incorporates a new and novel buoyancy compensator having a relief valve with an over-center valve plate which can be positively displaced. It incorporates a spring for positively biasing the valve cover on the valve seat without any further attendant means. This effectuates positive displacement of the valve cover under overpressure conditions. Additionally, the vest can be orally inflated by means of a new and novel oral inflator having a pushbutton valving arrangement.

The vest can incorporate the utilization of a quick inflation means such as a CO2 cartridge with a lever having a puncturing means. The vest also has an optional plug fitting for implacing apparatus to inflate the vest from a source of breathing gas which a diver carries. The apparatus can be threaded into the vest after removal of a threaded plug. When the filling apparatus has been implaced, it provides hand controlled filling from a tube connected at one end thereto.

The tube is connected to the filling apparatus by a quick release mechanism having a spring catch which overrides a groove at the end of the tube fitting. The filling apparatus incorporates a cooperative valving arrangement which is actuated by a button. The cooperative valving in part is provided by a Shrader type valve which seats positively in the tube fitting by means of a spring and plunger arrangement. The other end of the tube is provided with a fitting to seat within the first stage regulator which is attached to a source of breathing gas.

The entire vest can be made from a plastic inner bladder covered by an outer material which does not substantially stretch. The foregoing outer material can be provided with drainage holes for purposes of eliminating water to prevent rotting and substantially long drying periods. The configuration also allows for substantially complete inflation to reduce drag.

BRIEF DESCRIPTION OF THE DRAWINGS

The invention will be more clearly understood by reference to the description below taken in conjunction with the accompanying drawings wherein:

FIG. 6 shows an inflation apparatus which has been inserted in place of the adapter plug shown in FIG. 2;

FIG. 7 shows a side elevation view of the vest in its entirety along lines 7—7 of FIG. 1;

FIG. 10 shows a cross-sectional detailed view of the oral inflation valve attached to the inflation tube along lines 10—10 of FIG. 7;

FIG. 11 shows a sectional view of the inflation apparatus along lines 11—11 of FIG. 6; and, FIG. 12 shows a sectional view through the quick release means of the gas filling apparatus along lines 12—12 of FIG. 11.

THE PREFERRED EMBODIMENTS

A General Configuration

The general configuration of the buoyancy compensator provides for a collared type of inflatable vest 10. The vest 10 has an opening 12 through which a user's head can project, and surrounds a user's neck. A lower torso portion of the vest 14 provides a main floatation area. The remaining floatation portion of the vest includes a collar portion 16 surrounding the opening 12.

Figure 4:
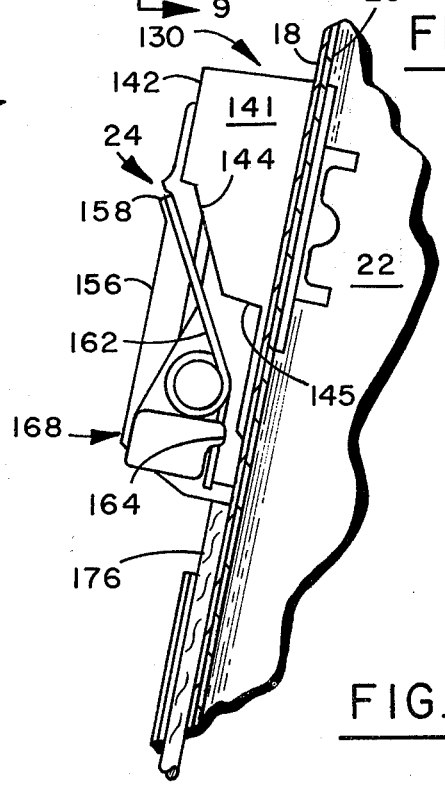
FIG. 4 shows a side view of the relief valve along lines 4—4 of FIG. 3, and a sectional view of the vest material.
Figure 8:
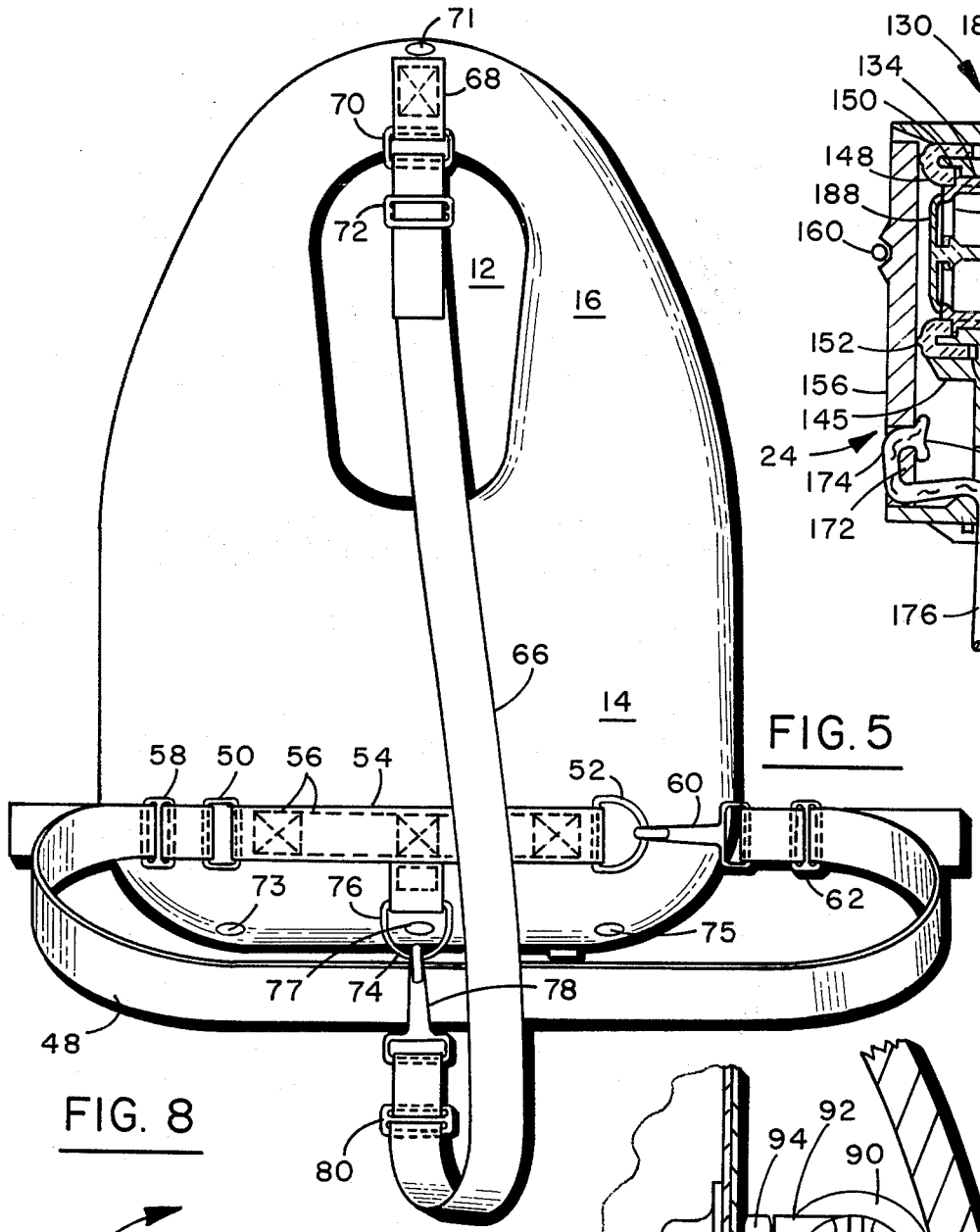
FIG. 8 shows a rear elevation view of the vest with the support straps attached thereto.
Figure 5:
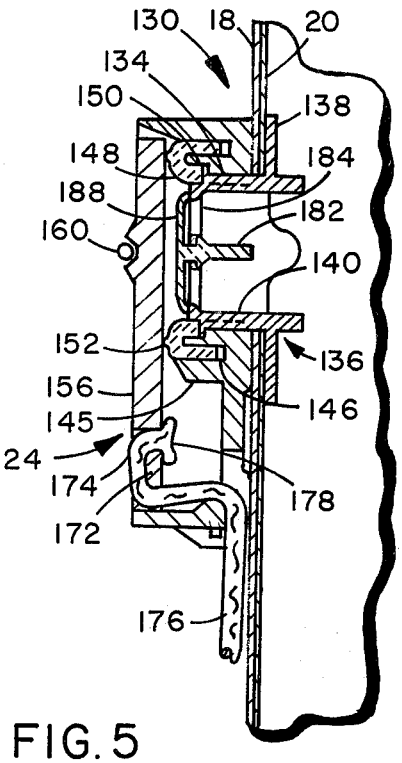
FIG. 5 shows a sectional view of the relief valve along lines 5—5 of FIG. 3.

The vest is made from an outer fabric 18 which can be seen in FIG. 4 as well as other portions of the figures showing a cross section through the vest material. The fabric 18 is of a substantially non-stretchable material, such as nylon, polyester, or a woven fabric. For that matter, any textile material will work as long as it provides a certain degree of tensile strength. A bladder or airtight material 20 is shown, which confines the air in the vest in an inner space or void 22.

The air within the vest expands in the airtight material 20 so that it is pressed against the non-expandable textile material 18. In this manner, the inner and outer portions can be made from separate materials to provide separate functions. The outer portion provides tensile strength to prevent inflation beyond the limitations of the strength characteristics of the inner airtight material 20 which has been formed into a bladder.

The inner cavity or void 22 is connected to a relief valve 24 which can be utilized for "dumping" excess amounts of gas within the vest 10. The valve 24 is operated by means of a cord 26 having a handle 28.

In order to provide rapid inflation of the vest 10, a cartridge and gas valve connection 30 is shown covered by a pouch 32. The pouch 32 has a flap 34 and serves to cover the rapid inflation means.

An oral inflation tube 36 with a mouthpiece and valve connection 38 connects to the bladder space 22. This serves the function of providing an oral inflation capability to the vest.

Figure 2:
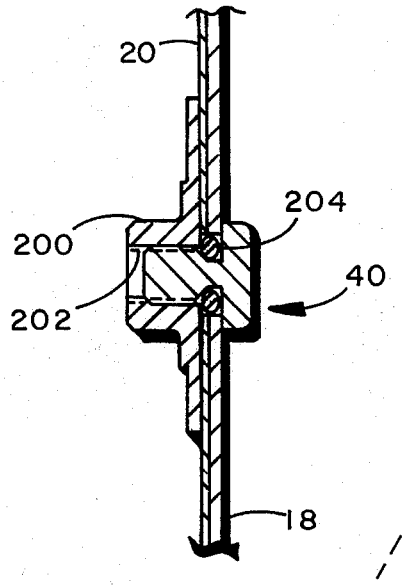
FIG. 2 is a sectional view along lines 2—2 of FIG. 1 showing the adapter plug for the inflation apparatus.

Looking more particularly at FIG. 2, a plug 40 is shown which has been fitted into the vest in an airtight fitting. The plug 40 is in a fitting which is sealed into the bladder material 20 to provide for the insertion of a breathing gas tank vest filling apparatus 42. The breathing gas tank vest filling apparatus 42 has a hose 44 by which it is connected to a source of breathing gas for purposes of filling the vest. In this manner, a user can quickly insert the hose 44 into the filling or inflating apparatus 42 to inflate the vest.

The vest is provided with a waist strap 48 which is secured to the lower portion of the vest 14 by means of rings 50 and 52 that have been stitched to the other material 18 of the vest. The foregoing is reinforced with a webbing 54 along the stitch lines 56 and 57 generally shown as dotted portions.

The waist strap has an adjustment loop 58 at one end for adjusting the length of the waist strap. It also has a releasable hook 60 and an adjusting loop 62. The releasable hook 60 can be hooked over the loop 52 and prevented from removal by means of a spring member which expands into the eye of the loop.

A crotch strap 66 is shown attached to the collar 16 of the vest by means of webbing 68 stitched down to the outer material 18 of the vest and provided with a loop 70 and adjustment loop 72. The lower portion of the crotch strap hooks onto a loop 74 which is secured and stitched to webbing 76 which is in turn stitched to the outer material 18 of the vest.

A hook 78 is shown with a spring member therein for holding the hook on the loop 74. The crotch strap 66 attached to the hook 78 is adjusted by means of a loop 80.

Drainage holes 71, 73, 75 and 77 are provided in the material 18. The holes can have an eyelet inset into the material 18. The holes effectuate drainage of water from the interface of the material 18 and 20, as well as providing better drying of the vest 10.

The foregoing generally describes the general structure of the vest. The following description will detail each one of the respective appurtenant portions of the vest which are provided therewith.

Rapid Inflation System

Figure 1:
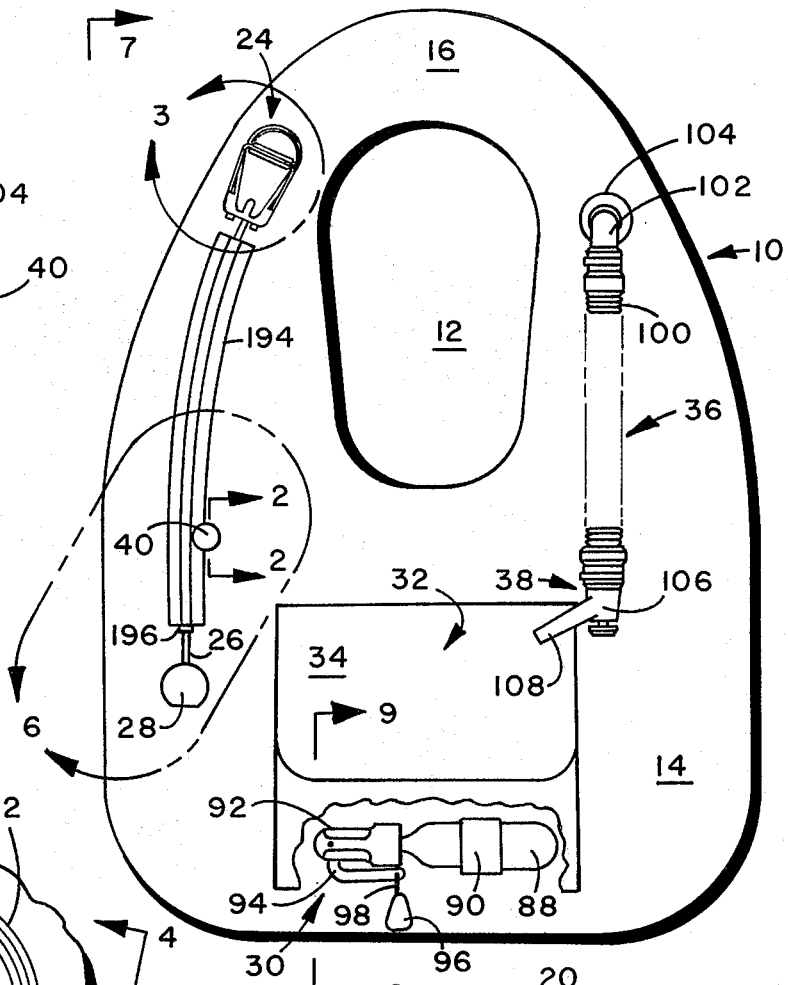
FIG. 1 shows a frontal elevation view of the buoyancy compensator which has been fragmented in part to show the rapid inflation means.
Figure 3:
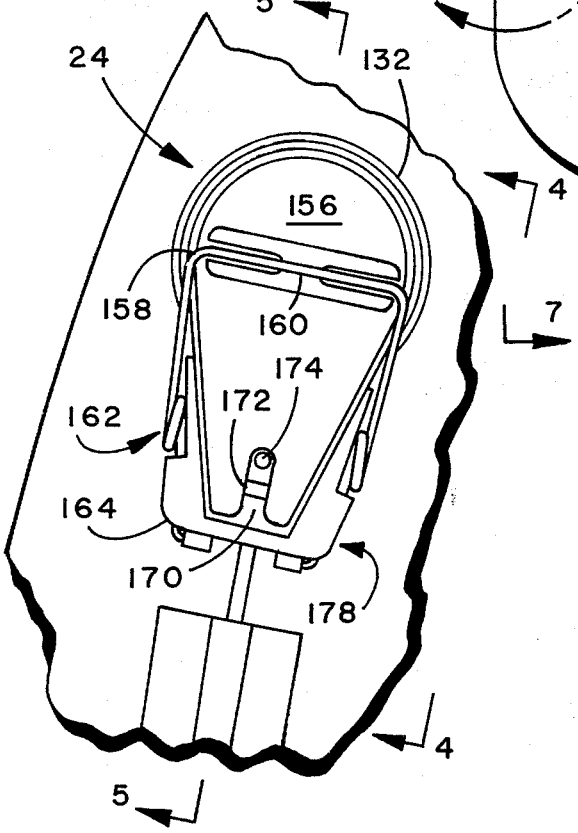
FIG. 3 shows an enlarged view of the relief valve that has been shown enclosed within Circle 3 of FIG. 1.
Figure 9:
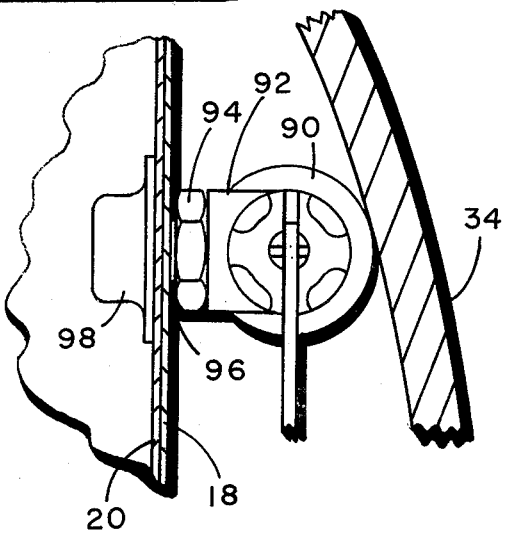
FIG. 9 shows an end view of the rapid inflation means along lines 9—9 of FIG. 1.

Looking more particularly at FIGS. 1, 7 and 9, a rapid inflation means 30 is shown. The rapid inflation means comprises a CO2 cartridge or pressurized bottle 88. The cartridge is secured by means of a collar 90 which is attached to the vest. The cartridge 88 fits into a combination valve and actuator housing 92. The valve and actuator housing 92 has a lever 94 pivotally connected on a pin for purposes of allowing a pointed object (not shown) to be driven into the cartridge 88. The lever 94 is actuated by a handle 96 attached to the lever 94 by means of a loop 98. The foregoing elements generally comprise the outside configuration of the rapid inflation means 30.

The rapid inflation means is secured to the vest material comprising the outer material 18 and inner material 20 by means of a nut 95 secured to a nipple 97 which passes into the bladder void 22. The foregoing is secured by means of a loop 99 to allow passage of gas from the bottle 88 after it is punctured by operation of the lever 94.

The foregoing serves to rapidly inflate the vest 10. This can extricate a diver in a situation wherein he wants to rapidly rise to the surface. Of course, the bottle 88 can be substituted by any suitable gas capsule or tank which can be rechargeable or replaced as in the case of a common CO2 cartridge.

Oral Inflation Device

Looking more particularly at FIGS. 1, 7 and 10 an oral inflation tube 36 is shown. The oral inflation tube 36 is of a relatively flexible material having ribs 100 along its length to provide bending of the tube 36 toward a diver's mouth. The tube 36 is connected by means of a ninety degree fitting 102 with a flanged attachment base 104 thereof for purposes of sealing it into the bladder material 20 internally of the vest.

At the other end, the rubber hose 36 is sealed by a plastic molded valve body portion 106 having a mouthpiece 108 for purposes of inflating a vest in the manner to be described. The mouthpiece 108 is configured to provide a proper seal on a cold diver's lips. The oral inflation valve body 106 which is attached to the end of the hose 36 has an inner passage with a valve surface 110, and a valve disc member 112 with an O Ring 114 for seating against the valve surface 110. The valve disc member 112 is attached to a plunger or stem 116 having a pushbutton 118 for purposes of depressing it with a user's fingers. The stem 116 is attached to the valve disc member 112 by having an extension thereof pass through the valve disc which has been threaded thereto at 120. The valve disc member 112 has an inner ledge 122 which receives a coil spring 124 to maintain the O Ring 114 against the valve surface 110.

At the base of the oral inflation valve 106 is an insert or washer 126 against which the spring 124 rests. The insert 126 can be in the form of any disc or washer which can be either threaded or held in place within the main body 106 by adhesive or heat setting.

The entire oral inflation means can be operated by merely depressing the button 118 and blowing through the oral extension 108 into the tube or hose 36 which is in direct connection to the inner portion of the bladder void 22. This causes a filling of the vest to the extent that one can blow up the vest by means of his lung capacity. It should be understood that the oral inflation means represents a safety factor, as well as a back-up system for inflation of the vest.

Relief Valve

The relief valve generally shown as valve 24, serves the purpose of allowing the gas in the vest cavity 22 to be exhausted therethrough and provides water drainage after cleaning and flushing. The relief valve comprises a plastic housing 130 having a base portion 136 which seats against the material 18 and 20 of the vest.

The housing or main body portion 130 is provided with threads 134 on an internal passage or opening therethrough for threading it onto the base 136. The base 136 has a flared circular portion 138 which is sealed to the interior of the bladder material 20. The base 136 has a neck 140 which receives the threads 134 to mate or connect the main portion 130 thereon. The threads 134 are only shown as being exemplary and can be substituted by any suitable means for affixing the base 136 to the housing 130.

The housing or main body portion 130 has a wall 141 which surrounds the opening provided between it and the connection point with the neck of the base 136. The wall 141 has a high semicircular portion 142 which slopes upwardly from a lower portion. The high portion 142 is approximately semicircular to the point of an angular section 144, where it meets a lower portion 145.

Within the wall 141, a groove 146 is provided. The groove 146 receives an elastomeric seal 148 which overlies an inner wall 150. In this manner, the skirt of the seal is depressed into the groove 146. A sealing circumferential protuberance or ring 152 formed in the seal rests on the wall 150 to provide a seal against a valve cover plate 156.

The valve cover plate 156 is shown with a cross sectional groove 158 which receives a cross member 160 of a spring 162. The spring 162 has a loop therein and is secured for bias within tabs 164 which keep the spring cross-arm 160 within the groove 158 of the valve cover 156. The valve cover 156 pivotally hinges over an intermediate point provided by the seal or ring 152. In this manner, it rests on the seal 152 over the wall 150 in a substantially equiplanar manner across the flats of the seal.

In order to hold the plate or valve cover 156 in place, the spring 162 forces it down on the seal 152 as well as controlling its location. Also, the plate is guided by means of the outer surrounding wall of the housing 130 and a triangularly shaped wall 168 which receives a triangular portion of the plate or valve cover 156. The triangular portion of the valve cover has a groove 170. The groove 170 has a cross member 172 which passes across the base of the groove. The cover plate 156 also has a hole 174 which serves to receive a cord 176 which is either heatset or knotted into an expanded form as a bulbous member 178 so that it is secured within the hole 174 of the plate 156. In this manner, the plate 156 can be pulled by the cord 176 against the pressure of the spring 162 so that it pivots backwardly on the circumferential seal 152. Thus, the plate or valve cover 156 is held in a planar relationship across the seal by spring 160 until the cord 176 pulls it downwardly and backwardly.

In order to prevent water from flowing into the vest within the void or cavity 22, a mushroom seal 182 is supported on a series of spokes 184, which bridge the neck 140 of the base 136. The mushroom 182 has a stem which extends inwardly into the neck 140 and has a round flapper valve surface 188 which rests across the top of the neck 140. The entire foregoing relief device allows for a release of pressure when the interior void 22 in the bladder 20 increases its pressure beyond the pivotal force or spring 162.

As can be appreciated, the spring 162 can be conformed to any configuration as a leaf spring or other spring biasing means to maintain the valve cover 156 against bladder pressure. In addition thereto, the entire relief valve configuration can be formed in any suitable manner, providing the valve cover plate 156 can pivot backwardly and relieve excess pressure within the bladder. The valve plate, of course, can be pivotally mounted by any means and need not merely rest on the valve surface 152 for its support. However, in this particular embodiment it is deemed to be a simple and expedient way as well as providing superior operative characteristics.

The valve cover plate 156 can be hand operated by the cord 26 by merely pulling the knob 28 attached to the cord 26.

In order to guide the cord 26, a fabric encasement 194 is stitched to the outer vest material 18. In addition to the fabric encasement 194, a plastic guide tube 196 can be affixed to the outside of the vest within the encasement 194. The plastic tube 196 can be affixed by any suitable attachment means such as metal clamps, clips, adhesives, heat setting, or frictionally held in the cover 194.

The main function of the encasement 194 and tube 196 is to provide guidance of the cord 26 therethrough. In this manner, a smooth and efficient operation of the cord is provided by merely pulling it, eliminating any binding, or sags, or causing it to get in the way of a diver.

Filling Apparatus

Looking more particularly at FIGS. 2, 6, 11 and 12, the filling apparatus 42 is shown which can be threadedly inserted in place of the plug 40. Specifically, a plug fitting 200 is shown adhered to the bladder material 20. The fitting 200 is provided with threads 202 which receive the plug 40. The plug 40 can accommodate an O Ring 204 for sealing the plug 40 into the fitting 200 to prevent the passage of gas through the fitting 200.

When the vest is used without the filling apparatus 42, it can be optionally provided with the plug 40 inserted into the fitting 200. In this manner, the filling apparatus 42 can be used as a separate apparatus affixed to the vest material and removed at will. This, of course, provides a vest or buoyancy compensator without any encumbrances. Also, certain first stage regulators do not come equipped with appropriate fittings for connecting the hose 44 thereto. In such cases, the filling apparatus 42 might not be capable of being used. As can be appreciated, if the first stage regulator does not have a fitting for connecting the hose 44 thereto, the filling apparatus 42 of this device cannot be used. In this mode, the plug 40 is inserted in the threads 202 of the fitting 200 thereby sealing the interior void 22 of the vest.

Looking more specifically at the apparatus 42, a showing is made of it attached to the vest. The apparatus has a main body portion 210 which has a cavity or passage 212 passing therethrough. The cavity 212 has a tapered end portion 214 which can receive an end fitting 216 of the hose 44.

The hose 44 is provided with a circumferential metal end cap fitting 218 which has a threaded portion 220 extending therefrom. The threaded portion 220 has an integral nut 222 with an O Ring 224 for sealing purposes. This enables the threaded portion 220 to be fitted into an outlet of a first stage regulator, or any other source of pressurized gas, for conduction thereof through the opening in the tube 44.

The fitting or threaded portion 220 when placed in the opening of a first stage regulator, provides a source of gas. However, it should be understood that the source of gas can emanate from any particular location. In other words, as long as a source of pressure is provided in a fitting into which the threaded portion 220 of the end fitting 218 can be threaded, there will be sufficient gas to operate the filling apparatus 42 which is connected at the other end thereof.

Looking more specifically at the other end of the hose 44, a second end fitting 228 is utilized to hold the hose to the insertable portion 216. The insertable fitting 216 is held in place by means of a spring 230. The spring 230 is placed and held within a groove 232 of the main body portion 210. The spring 230 has a handle or tab 234 for purposes of expanding the spring into the dotted configuration shown in the direction of Arrow A of FIG. 12. The spring 230 when expanded circumferentially outwardly in the direction of Arrow A, relieves the spring 230 from engaging a groove 236 of the insertable end fitting 216. This consequently enables the insertable end fitting 216 to slide into the cavity 212 and be quickly inserted therein. More particularly, the insertable end fitting 216 has a tapered angular portion 238 which bears against the spring 230 when it is being inserted into the openings 212. The slanted surface 238 cams the spring 230 upwardly as it glides thereunder. As the insertable end portion 216 moves into the cavity 212, the spring 230 finally comes to rest within a groove 236 of the insertable end portion.

Figure 12:
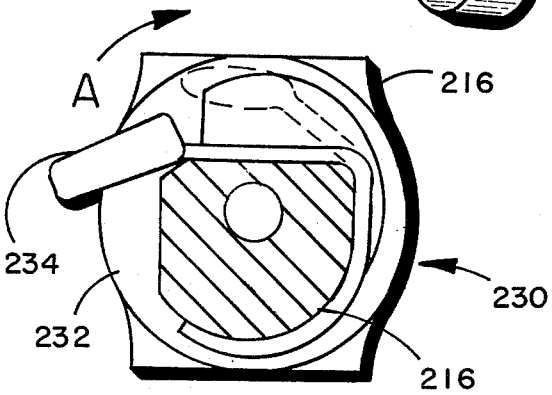

The insertable end portion 216 is held in place by the spring 230 until the handle or tab 234 is rotated in the direction of Arrow A of FIG. 12. At this time, it will relieve the spring clip on the groove 236 of the insertable member 216.

The insertable member 216 is partially sealed in the opening of cavity 212 of the main body portion 210 by means of an O Ring 240. When emplaced, the O Ring is depressed into a sealing relationship with the side walls of the cavity 212.

The insertable end portion 216 has a Shrader valve 242 threaded by means of threads 244 into a threaded opening of the insertable end portion. The Shrader valve is commonly used for inflatable tire valving and is also known for other sealing means when a depressable spring biased item is required for opening the valve. More specifically, a depressable plunger 248 of a Shrader valve having a mushroom head is biased by a spring 250 therein. The spring 250 allows a circumferential elastomeric sealing portion generally shown at 252 to seal itself against the interior walls of the cavity within the insertable portion 216. This permits the passage of gas from an opening 254 in connected relationship to the hose 44, so that the passage of gas can pass from the hose 44 through the interior portion of the insertable member 216 when the Shrader valve plunger 248 is depressed. In the normal position without the Shrader valve plunger 248 depressed, there is a seal provided by the valve so that no gas will emanate from the hose 44 through the opening 254.

Looking more particularly at the main body portion 210, an opening having a stem 260 therethrough, is shown with a button 262 threaded thereon by threads 264. The button 262 has a rounded, disc-shaped bottom 266 which receives a coil spring 268 between it and a washer 270. The washer 270 allows a sliding movement of the stem 260 through the passage provided in the main body portion 210. In order to seal the stem 260, in the main body portion 210, an O Ring 274 is placed around the stem. The stem 260 terminates in a valve member formed as an enlarged end portion 276 having a forward and rearward taper. Inbetween the tapering ends, a groove 278 is cut which receives an O Ring 280. The O Ring fits against a sloping portion 284 of the cavity 212 so that it can provide a seal when it is thereagainst. The seal serves basically as a back pressure seal so that gas within the vest cavity 22 will not pass out of the filling apparatus 42.

When the plug 40 is removed, either as an optional removal, or during manufacture, a stud 288 with a cap 290 having a screw slot 292 therein is threaded into the threads 202 of the fitting 200. The stud 288, of course, has threads 294 which match the threads 202. In addition thereto, a hexagonal nut 300 is utilized for holding the stud 288 in a secured relationship within the threads 202. The stud 288 has a diametrical passage or slit cut therein, permitting passage of stem 260 therethrough.

The stud and cap 290 is sealed by means of O Rings 304, 306 and 308 within the respective portions of the main body 210 of the filling apparatus 42 as well as the fitting 200. A passage 310 allows the passages 254 and cavity 212 to pass gas through the bore of the passage.

In operation, the main body portion 210 of the filling apparatus 43 is threaded to the fitting 200. When it is desired to fill the vest from the breathing gas tank, the threaded end fitting 220 of the hose is inserted into an opening or port within the first stage regulator or any other place where gas can be derived from a diver's breathing gas tank.

If the insertable portion 216 has not been inserted in the main body member 210, it is inserted by pushing the sloping edge 238 against the spring 230 until the spring is received in the groove 236 and the insertable portion 216 is secured thereby in the opening of the cavity 212.

When filling of the vest or buoyancy compensator 10 is desired, the button 262 is depressed, thereby allowing the passage of gas from cavity 212 into the bore 310 of the stud 288. Of course, the passage of gas cannot take place until the leading end of the expanded portion 276 of the stem 260 contacts the stem 248 of the Shrader valve 242. The leading end of protuberance 276 thus displaces the Shrader valve seal 252 sufficiently to allow the passage of gas. However, as can be understood, the passage of gas is controllable, depending upon the amount of displacement of the Shrader valve by the amount of depression of the button 262.

After a sufficient amount of gas has been delivered to the vest cavity 22, the button 262 is released, allowing the usage of the vest as a buoyancy compensator or general floatation means. If the gas pressure exceeds the spring loading of the spring 162 of the relief valve, the valve plate 156 will open and "dump" the gas from the interior void 22 of the vest to the surrounding water. The foregoing effectuates a balance of the amount of gas the vest can accommodate itself to and also the particular level at which the diver is diving.

As can be understood, the buoyancy compensator of this invention can be utilized with and without the filling apparatus 42 and in various modes. Furthermore, it can be utilized as a combination of all of the foregoing elements, or with certain singular elements which provide the novel features for filling and gas pressure control. As a consequence, this vest has substantial variety in its uses and application, as well as the mode in which the vest can be manufactured. Thus, this invention is only to be read in light of the following claims as to its breadth and scope.

We claim:

1. A buoyancy compensator for providing a diver with buoyancy gas comprising:

a vest having a collar and an opening through which a user's head can pass made of an outer textile material which has a limited degree of stretchability with a substantially freely implaced plastic inner bladder having a communicating void therein which conforms to the outer material substantially throughout the entirety of the outer material and is controlled in its expansion to the limits of the outer material expansion;

straps attached to the vest for maintaining the vest on a user's body;

an oral filling means comprising a flexible tube connected to the interior of said vest at one end of said tube, with an oral inflation valve assembly at the other end of said tube having a mouthpiece connected to a valve housing, with a spring biased hand operated valve member for sealing against the interior of said housing to prevent the escape of gas therethrough connected to an operating member at least partially exposed extrinsically to said housing, so that when said valve member is moved from the valve housing by said operating member, it will permit oral inflation of said vest; and, a relief valve connected to the vest for release of pressure within the cavity of said vest.

2. A buoyancy compensator for providing a diver with buoyancy gas comprising:

a vest having a collar and an opening through which a user's head can pass;

straps attached to the vest for maintaining the vest on a user's body;

an oral filling means comprising a flexible tube connected to the interior of said vest at one end of said tube, with an oral inflation valve assembly at the other end of said tube having a mouthpiece connected to a valve housing, with a spring biased hand operated valve member for sealing against the interior of said housing to prevent the escape of gas therethrough connected to an operating member at least partially exposed extrinsically to said housing, so that when said valve member is moved from the valve housing by said operating member, it will permit oral inflation of said vest;

a fitting passing from the interior of said vest to the exterior thereof to provide a housing on the exterior of said fitting having a passage through said housing and said fitting;

a valve cover attached to said housing for covering the opening of said housing;

spring biasing means for maintaining said valve cover in a normally closed position; and, opening means operably connected to said valve cover to provide manual displacement of said valve cover against said spring biasing means.

3. The buoyancy compensator as claimed in claim 2 wherein:

said opening means comprises a cord attached to said valve cover; and, said valve cover comprises a valve cover having an offset portion rotatable through its planar surface to which said cord is attached, and which is operatively opened by means of overcoming an opposing force provided by the spring biasing means.

4. The vest as claimed in claim 1 further comprising:

a source of pressurized gas;

a valve having a handle for opening the source of pressurized gas; and, a fitting connected to said valve for passage of gas into said vest.

5. The buoyancy compensator as claimed in claim 4 wherein:

said gas source comprises a compressed gas cartridge; and, said valve comprises a valve adapted to receive said compressed gas cartridge, and having a means for piercing a closure of said compressed gas cartridge by a lever forming its handle.

6. A buoyancy compensator comprising:

a vest having a collar and an opening through which a user's head can pass;

straps attached to the vest for maintaining the vest on a user's body;

an oral filling means comprising a flexible tube connected to the interior of said vest at one end of said tube, with an oral inflation valve assembly at the other end of said tube having a mouthpiece connected to a valve housing;

a relief valve comprising a housing with an opening having a passage fitted to said vest and passing to the interior thereof with a spring biased valve cover overlying said passage and means operably connected to said valve cover to manually move said valve cover from over said passage against the spring bias;

and a filling apparatus comprising:

a hose adapted for connection to a source of breathing gas;

a valved fitting on said hose at the distal end from where said hose is connected to said breathing gas source;

a housing with an axial passage adapted to receive said valved fitting;

a gas passage from said housing into said vest;

means for locking the valved fitting of said hose to said housing; and, means for valving the gas from said hose through said housing into said vest for filling the vest.

7. The buoyancy compensator as claimed in claim 6 wherein the filling apparatus for filling the vest further comprises:

a valve connected within the valved fitting of said hose;

spring biasing means for maintaining said valve in a normally closed position; and, a plunger extending from said valve in said valved fitting with means associated therewith to press said plunger extrinsic to said housing to operate said valve of said valved fitting.

8. The filling apparatus as claimed in claim 7 further comprising:

a second plunger having a stem mounted axially within said housing;

a valving member attached to said second plunger stem having an O Ring thereon; and, a valve surface against which said O Ring seals, wherein said second plunger can operatively depress said first plunger of said valved hose fitting, while at the same time opening a passage through said housing to the interior of said vest.

9. The apparatus as claimed in claim 6 wherein said locking means comprises:

a depression within said valved hose fitting; and, a spring biased member of said housing which operatively moves across the axial passage in said housing for receiving said valved hose fitting for engaging said depression of said valved hose fitting.

10. The apparatus as claimed in claim 9 wherein said spring biased member comprises:

a member having a handle thereon;

means for attaching said spring biased member to said housing; and, wherein the spring biased member is operated by said handle to remove it from said depression of said valved hose fitting.

* * * * *